US011937711B1

(12) United States Patent
Reynolds, Jr. et al.

(10) Patent No.: US 11,937,711 B1
(45) Date of Patent: Mar. 26, 2024

(54) ITEM DISPLAY CASE AND SYSTEM

(71) Applicants: Lawrence Richard Reynolds, Jr., Dallas, TX (US); Scott James Harben, Plano, TX (US)

(72) Inventors: Lawrence Richard Reynolds, Jr., Dallas, TX (US); Scott James Harben, Plano, TX (US)

( * ) Notice: Subject to any disclaimer, the term of this patent is extended or adjusted under 35 U.S.C. 154(b) by 0 days.

(21) Appl. No.: 18/516,591

(22) Filed: Nov. 21, 2023

Related U.S. Application Data

(60) Provisional application No. 63/427,021, filed on Nov. 21, 2022.

(51) Int. Cl.
*A47F 3/00* (2006.01)

(52) U.S. Cl.
CPC ..... *A47F 3/001* (2013.01)

(58) Field of Classification Search
CPC ..... A47F 3/001
See application file for complete search history.

(56) References Cited

U.S. PATENT DOCUMENTS

| | | | | |
|---|---|---|---|---|
| 11,503,925 | B1 * | 11/2022 | Walker | A47F 3/001 |
| 2011/0204009 | A1 * | 8/2011 | Karan | A47F 1/12 362/125 |
| 2014/0218896 | A1 * | 8/2014 | Karan | F21V 23/06 362/132 |
| 2019/0053640 | A1 * | 2/2019 | Min | A47F 3/005 |
| 2019/0391405 | A1 | 12/2019 | Takechi et al. | |
| 2021/0208420 | A1 | 7/2021 | Kim et al. | |
| 2022/0128188 | A1 | 4/2022 | Bai et al. | |

* cited by examiner

*Primary Examiner* — Thomas M Sember
(74) *Attorney, Agent, or Firm* — Plager Schack LLP; Mark H. Plager; Naomi Mann

(57) ABSTRACT

A display system for display of an item includes a display case into which the item may be placed, a digital video display system, and a lighting system which may be interactive with the video display system to provide an animated, photo-realistic and dynamic background for items being showcased and/or photographed. In certain embodiments, the display case includes a back wall incorporating an output video screen configured to display custom video content of the user's choosing via the digital video display system, the custom videos providing a backdrop for the item being displayed, wherein the lighting system is configured to change color and/or intensity in sync with the color of the changing images produced on the video output screen.

10 Claims, 7 Drawing Sheets

600

ITEM DISPLAY CASE AND SYSTEM

RELATED APPLICATION

This application claims benefit to U.S. Application No. 63/427,021 filed Nov. 21, 2022, which is incorporated by reference herein in its entirety.

BACKGROUND

The present disclosure relates generally to display cases for showcasing collectibles and other items.

Enhancing the presentation of an item on display may signal its uniqueness, draw favorable attention to the item, and/or affect its perceived value. As such, an improved item display system is desirable.

SUMMARY

According to various embodiments, disclosed is a display system for display of an item, the display system including a digital video display system and a lighting system which is interactive with the video display system. In some embodiments, the display system may comprise a display case into which the item may be placed, wherein the digital video display system and lighting system provide an animated and dynamic background for items being showcased and/or photographed. In certain embodiments, the display case includes a back wall incorporating a video output screen configured to display custom video content of the user's choosing via the digital video display system, the custom videos providing a narrative backdrop for items placed in the display case, wherein the lighting system is configured to change color and/or intensity in sync with the color of the imagery displayed on the video output screen.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
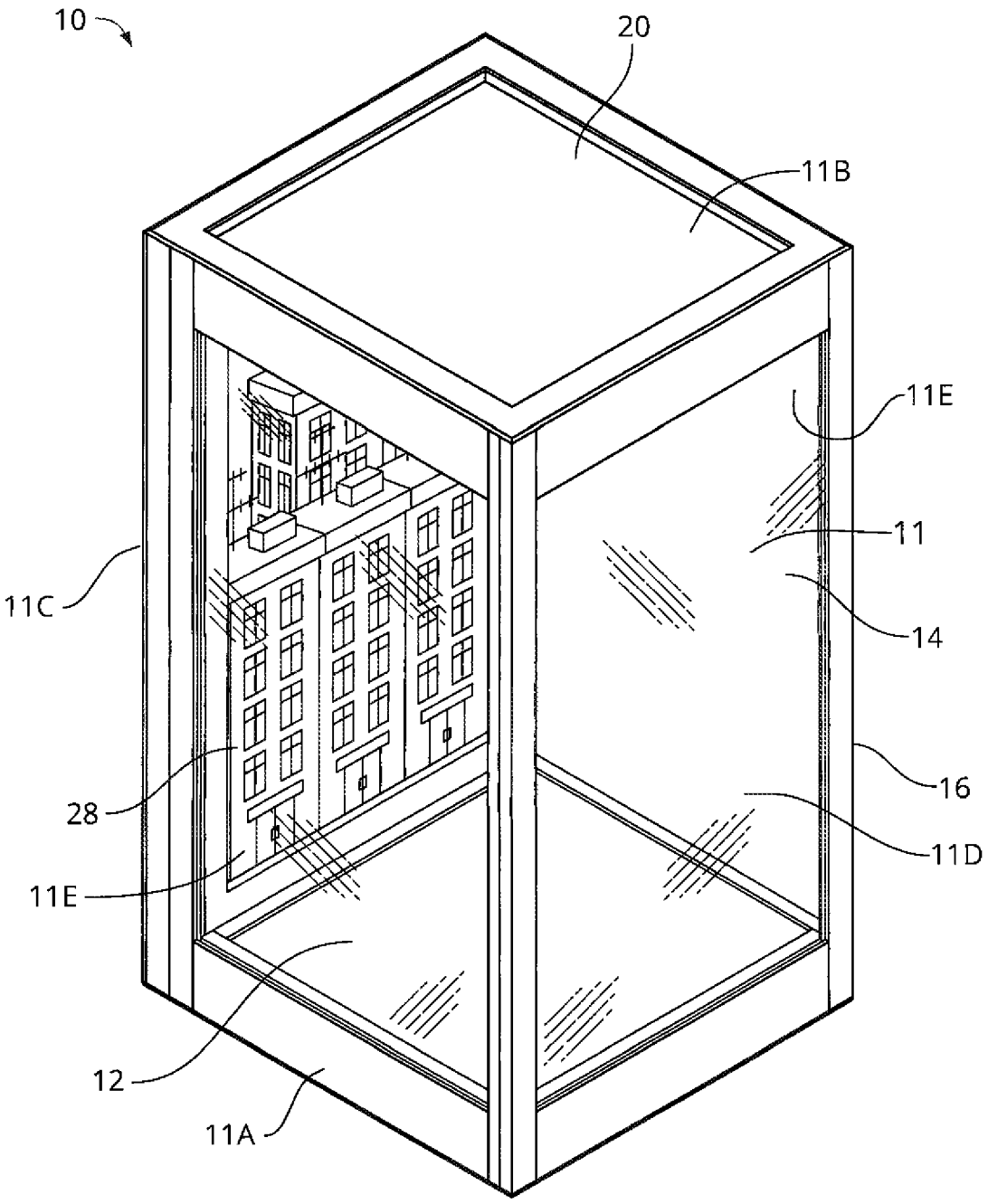
FIG. 1 is a top front perspective view of a display case according to various embodiments.
Figure 2:
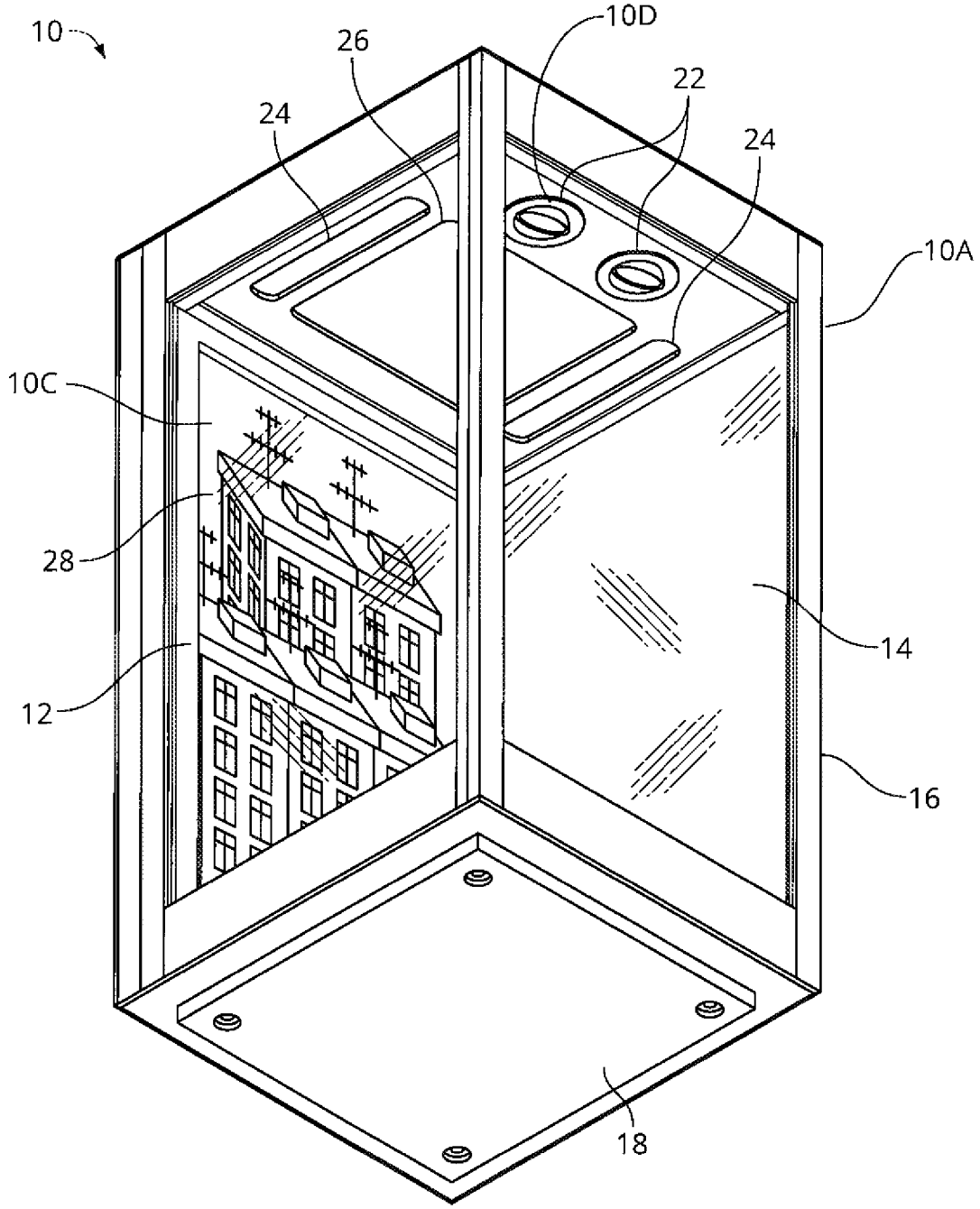
FIG. 2 is a bottom front perspective view of the display case of FIG. 1.
Figure 3:
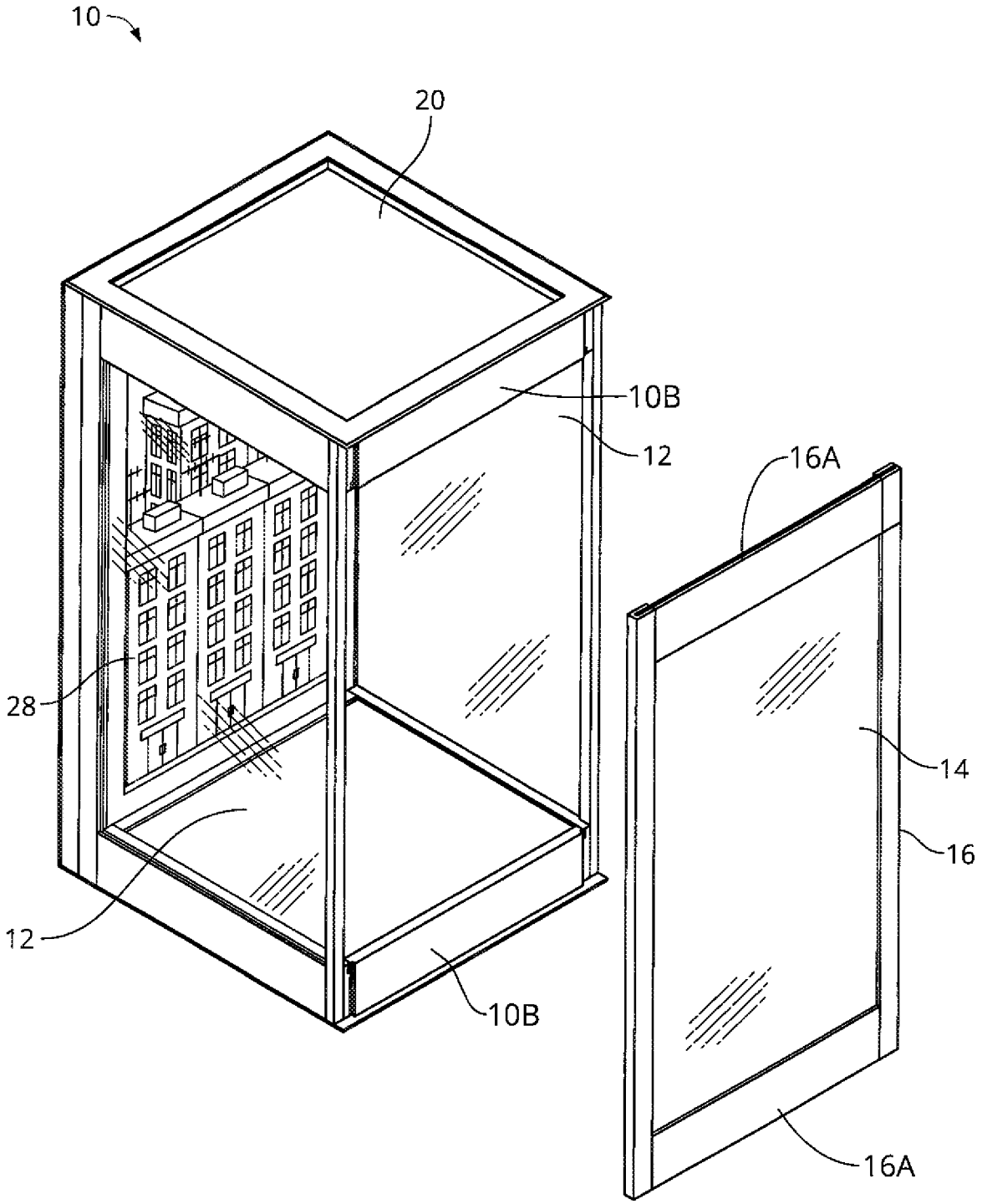
FIG. 3 is a top perspective view of the display case, with a front window of the display case removed to open the display case.
Figure 4:
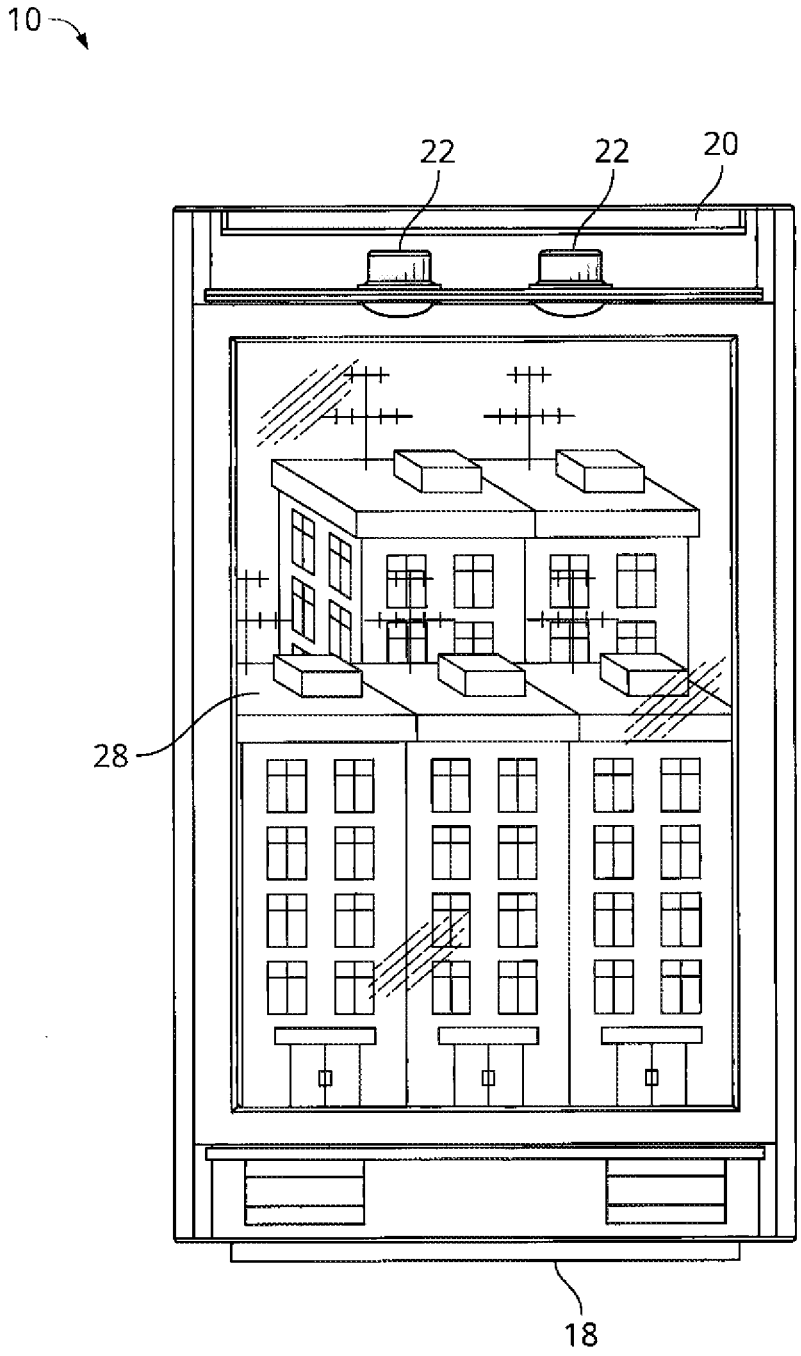
FIG. 4 is a front view of the display case with the front panel removed.
Figure 5:
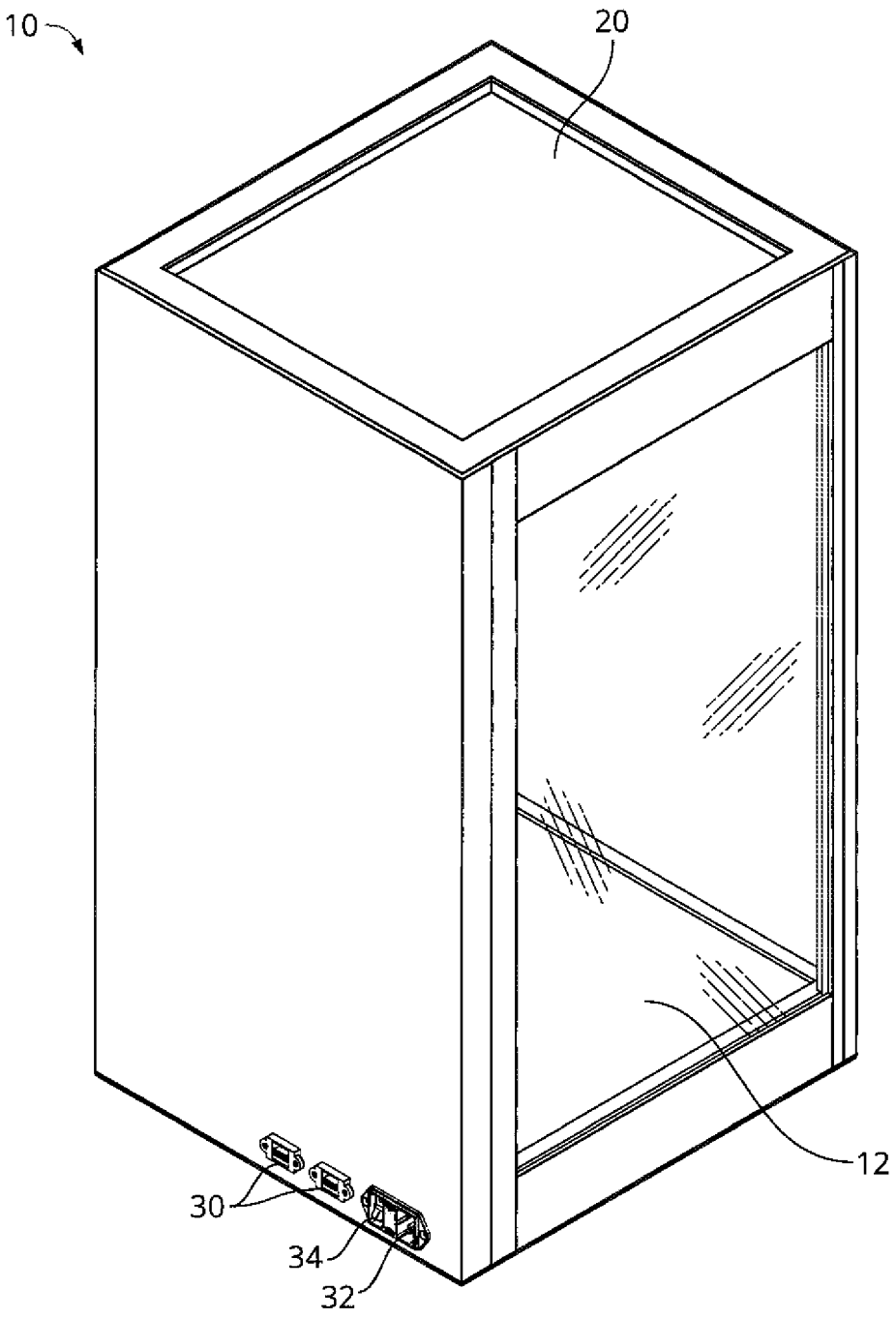
FIG. 5 is a top rear perspective view of the display case.

According to various embodiments as depicted in FIGS. 1-7 disclosed is an item display system 600 comprising a display case 10 including electronic/digital video display and lighting systems, which may be interactive to provide a realistic, animated, and dynamic background for items being showcased and/or photographed. In certain embodiments, display case 10 may be used to showcase various items placed inside the case. According to various embodiments, display case 10 may be used to display artwork of any type (e.g., statues, paintings, pottery, etc.), architectural models, sports memorabilia, vintage/antique items (e.g., clothing, jewelry, toys, etc.), historical artifacts, awards (e.g., trophies, medals, plaques, etc.), presentation/teaching aid props, various consumer items (e.g., new electronic items, jewelry, accessories, beverages, health and beauty product, etc.), etc. In some embodiments, display case 10 may be used to assist individuals in photographing various items, such as consumer items to be sold online and/or advertised. In further embodiments, display case 10 may be used in retail and trade show environments as a display enhancement for a variety of consumer products. In some embodiments, display case 10 may also protect valuable items being displayed. In certain embodiments, display case 10 may be stackable atop another display case 10 (see FIG. 7).

In certain embodiments, display case 10 may generally comprise a display case structural frame 10A configured to retain display case structural walls which define a display case enclosure 11 and include at least one transparent window member. Display case 10 may further comprise a digital video display system 10C including video output screen 28, and a lighting system 10D comprising various lighting elements. In some embodiments, video display system 10C is configured to display a video but may also display a slide show and/or still images in alternate embodiments. In some further alternate embodiments, video display system 10C may be accompanied by sound effects. In certain embodiments, lighting system 10D may be configured to produce position and/or intensity adjustable illumination, colored lighting, and/or various other lighting effects, as it interacts with video display system 10C. In some embodiments, lighting system 10D produces light which changes in color and/or intensity in response to the changing images produced on output screen 28. In one embodiment, the lights produced change color and intensity in sync with the color changes of the video being displayed.

In certain embodiments as depicted in the figures, the display case structural walls may include a bottom wall 11A providing a display case support platform for the item to be displayed, a top wall 11B, a rear wall 11C, a front wall 11D, and a pair of opposing side walls 11E. Walls 11A, 11B, 11C, 11D and 11E, in conjunction with structural frame 10A, are arranged to form a rectangular prism and/or cube surrounding enclosure 11, wherein opposing walls are in planar parallel alignment and adjacent walls are in perpendicular planar alignment to one another (as used herein, the term "rectangular" is defined as also including a square). It shall be appreciated that while display case is depicted as oriented vertically with respect to its long axis, the case may also be designed for a horizontal orientation. Additionally, it shall be appreciated that display case 10 may have different geometric configurations in alternate embodiments. In certain embodiment, side walls 11E may comprise transparent side windows 12 which may be made of glass, acrylic, or other material having optical transparent properties. In some embodiments, side windows 12 may be permanently attached to structural frame 10A. In other embodiments, one or both of side windows 12 may be removable from the frame to provide an opening for inserting or removing a display item from the display case. In some embodiments, the vertical posts of structural frame 10A may include grooved channels configured to receive side windows 12, enabling side windows 12 to be slid into or out of the frame. In an alternate embodiment, windows 12 may be magnetically attachable to the frame via co-attractive magnetic elements provided on the posts of the frame and windows 12.

In certain embodiments, front wall 11D may comprise a transparent front window 14 which may be made of glass, acrylic, or other material having optical transparent properties. In some embodiments, front window 14 may be permanently attached to structural frame 10A. In other embodiments, front window 14 may be removable from the frame to provide an opening for inserting or removing a display item from the display case. In some embodiments, the vertical posts of structural frame 10A may include grooved channels configured to receive front window 14, enabling window to be slid into or out of the frame. In an alternate embodiment, window 14 may be magnetically attachable to the frame via co-attractive magnetic elements provided on the posts and window. For example, window 14 may include a window frame 16, wherein co-attractive magnetic elements 16A and 10B may be provided on top and bottom sections of window frame 16 and structural frame 10A, respectively (see FIG. 3). It shall be appreciated that different enclosure mechanisms may be used (e.g., a hinged window, a slidable window, etc.), and that different walls or combination of walls may be made removable and/or openable with respect to structural frame 10A in alternate embodiments.

In certain embodiments, bottom wall 11A and top wall 11B may include top and bottom connection element to enable multiple display cases 10 to be securely stacked atop one another. To this end, and in accordance with certain embodiments, bottom wall 11A may comprise a stacking foot 18, and top wall 11B may comprise a stacking cavity 20 (or vice versa), wherein stacking foot 18 is configured to insert into stacking cavity 20 (see FIG. 7). In some embodiments, up to 3 display cases may be vertically stacked. In some embodiments, multiple stacked units may be in electrical and/or wireless communication to reduce the need for multiple power cords. In alternate embodiments, multiple display cases may be configured to horizontally connect, with stacking cavity 20 and stacking foot 18 provided within side walls of the cases. This may enable lining multiple cases together to create a wider panoramic display, capable of holding multiple display items. In some further embodiments, multiple display cases may be configured to stack both vertically and horizontally, via side and top and bottom stacking feet 18 and stacking cavities 20. It shall be appreciated that various components may be used to secure stacked display case units or otherwise connect them. It shall be understood that stacked display case units may simply sit atop one another without extraneous securing/stacking elements.

In some embodiments, output screen 28 of video display system 10C may be integrated with rear wall 11C and provides a digital backdrop for items placed inside the case. In certain embodiments, a user may upload image and/or video content via an auxiliary device thorough auxiliary input port 30 (e.g., USB or HDMI port). In certain embodiments, the image/video content may loop to play for an indefinite period or be changed to suit a user's needs. It is noted that the various building images shown on screen 28 in FIGS. 1-4 and 7 are for illustrative purposes only; it shall be understood that any type of video or images may be shown on screen 28.

In certain embodiments, lighting system 10D may comprise various lighting elements, which may be coupled to an internal side of top wall 11B, and are configured to cast light onto the item inside the case. In some embodiments, lighting system 10D may include at least one lighting element configured to change color and/or intensity in sync with the imagery on screen 28. In one embodiment, the colors shown on the screen are mimicked by the color changing lights which illuminate the item on display. In one embodiment, lighting system comprises a pair of gimbal LED spotlights 22, a center ambient fill light 26, and side ambient fill lights 24, as shown. It shall be appreciated that different lighting elements and combinations thereof may be used in alternate embodiments and may be attached at various locations within display case 10. For example, lighting elements may be attached to structural frame 10A in alternate embodiments.

In some embodiments, display case 10 may include various power, control, electronic, circuitry, and input elements supporting video display system 10C and lighting system 10D. These elements may be housed, for example, in a compartment provided within bottom wall 11A and/or top wall 11B. In one embodiment, an A/C power output port 32 and a power switch 34 may be provided for powering the system via an external power cord. In some embodiments, one or more D/C auxiliary input port(s) 30 may be provided for enabling video content to be loaded for video display system 10C. It shall be appreciated that different power supply and/or video input/control systems may be provided in alternate embodiments. For example, in some embodiments, display case 10 may be battery powered, or multiple cases may be daisy chained together to share power. In some embodiments, a mobile control app may be provided for Bluetooth operation of the video display system.

Figure 6:
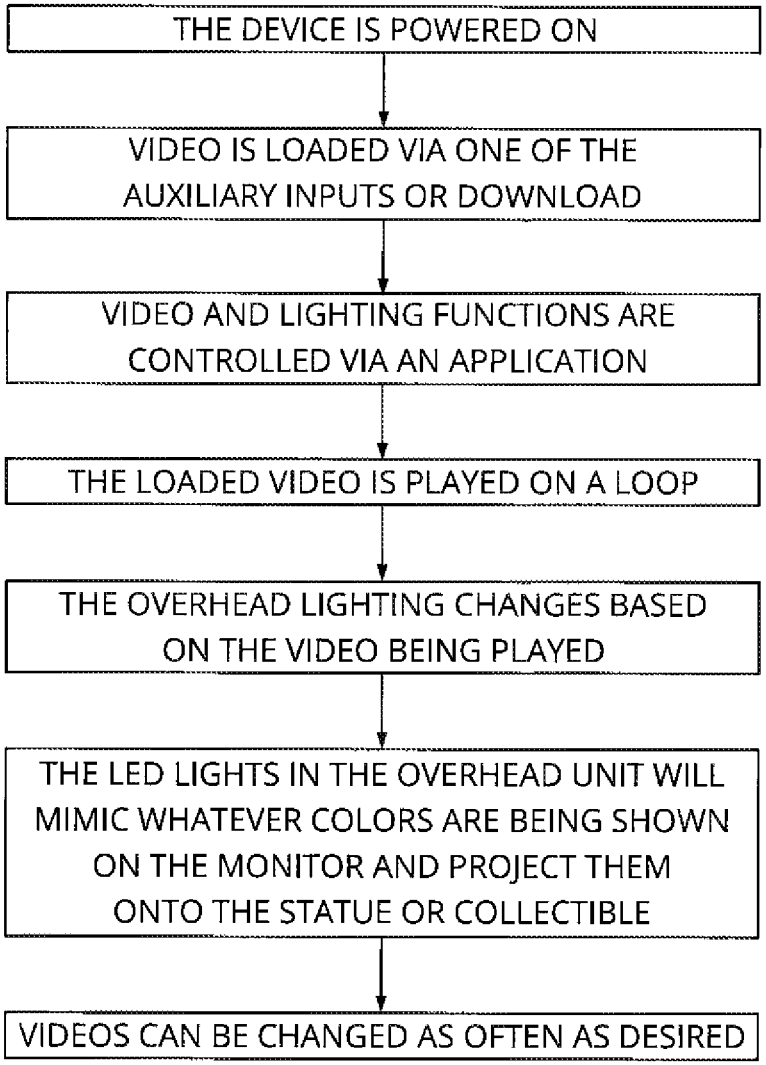
FIG. 6 a flow chart for an item display system, according to certain embodiments.
Figure 7:
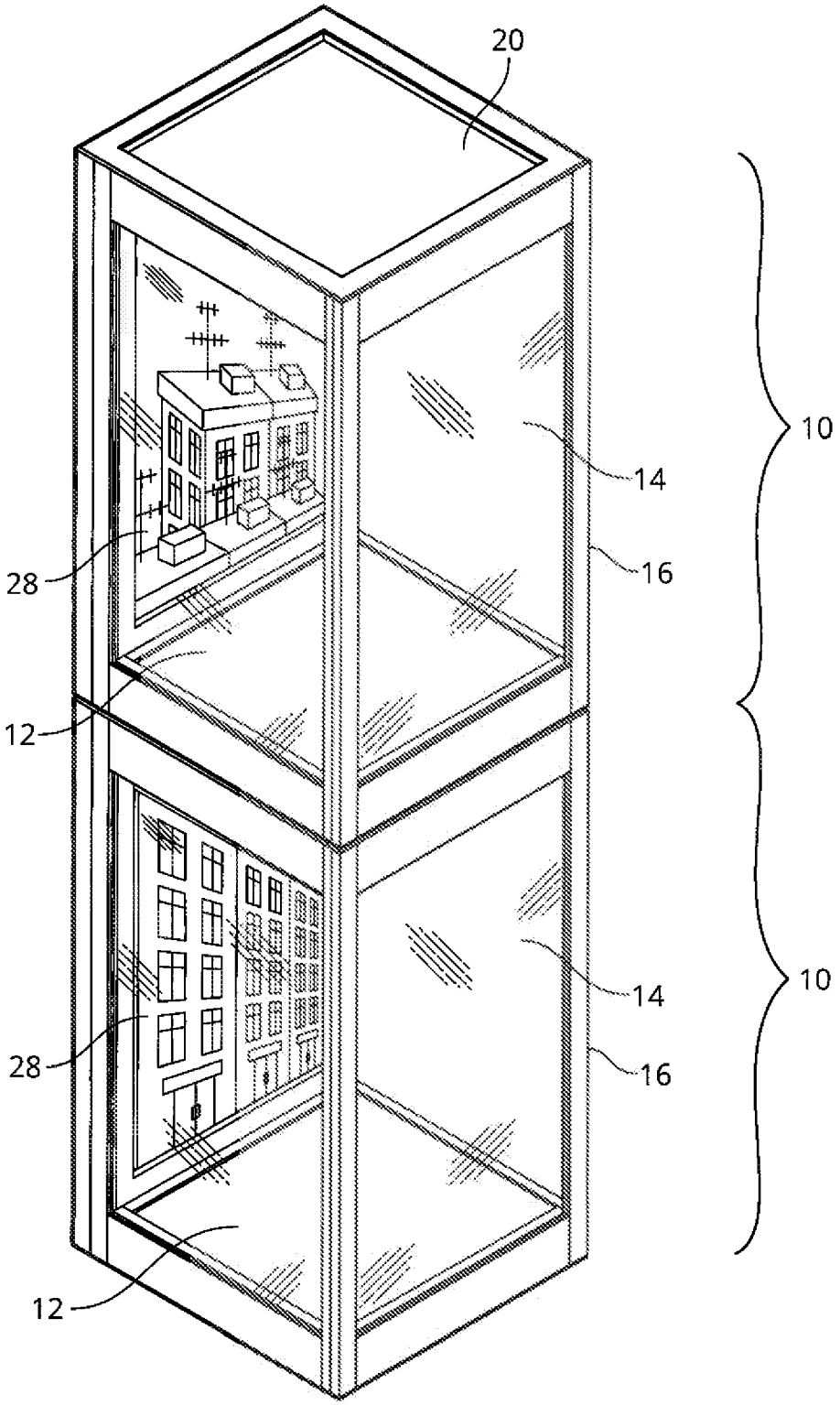
FIG. 7 is a top front perspective view illustrating stacking of two display cases, according to various embodiments.

According to an exemplary embodiment as depicted in FIG. 6 display system 600 may comprise placing an item for display within display case 10, then powering on video display system 10C and lighting system 10D via switch 34 (or a control app) to play video content on screen 28, with synchronized lighting directed at the item displayed. In certain embodiments, the system lights may mimic the colors and light intensity in the video being played. In some embodiment, video files may be loaded via one of auxiliary input ports 30. In certain embodiments, the video may play in a loop for an indefinite duration and may be changed anytime by the user as desired.

Thus, the disclosed system provides a display case which may be used by collectors, hobbyists, photographers, retailers, museums, etc., to dramatically enhance the appearance of an item. The system allows the user to select any video background that compliments the item being displayed, for boundless options in creating a display that is dynamic and elevates the presentation of the item.

It shall be appreciated that the disclosed device and system can have multiple configurations in different embodiments. In certain embodiments, various decorative elements may be added to the display case 10. For example, a display stand may be provided for a floor display, and/or the top or bottom walls may be provided with decorative a topper and/or base.

According to an exemplary embodiment, display case 10 may have a total height of about 25 to about 30 inches, or about 28.25 inches, and a square cross section with width and depth dimensions of between about 12 inches and about 18 inches, or about 15.63 inches. stacking foot 18 and stacking cavity 20 may each span a height of about 0.25 inches, to about 1 inch, or about 0.5 inches, and may have an offset of about 1 inch from the side edges of the display case structural walls. It shall be appreciated however, that display case 10 may be made in any size/dimensions for accommodating display items of various sizes, different user needs and/or preferences, etc. It shall be appreciated that the device and system described herein may comprise any alternative known materials in the field and be of any color, size, and/or dimensions. It shall be appreciated that the device may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as approximate, 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A display case for displaying an item, the display case comprising:

display case structural walls, including a back wall and a bottom wall coupled to the back wall, the bottom wall providing a display case support platform for the item to be displayed; and a lighting system configured to illuminate said item placed on the display case support platform, wherein the back wall comprises a video output screen, wherein the video output screen is configured to display video content via a digital video display system, the video content providing a backdrop for said item placed on the display case support platform, and wherein the lighting system includes at least one lighting element configured to change color and/or intensity in sync with the color of the video displayed on the video output screen.

2. The display case of claim 1, wherein the display case structural walls are configured to form an enclosed space around said item placed on the display case support platform, and wherein the display case structural walls include at least one transparent window.

3. The display case of claim 2, wherein at least one of the structural walls is configured to move between a first position that creates an opening in the enclosed space, and a second position that encloses the enclosed space.

4. The display case of claim 3, further comprising a structural frame configured to retain the display case structural walls.

5. The display case of claim 4, the display case structural walls further comprising a top wall, the structural frame forming a rectangular prism and is configured to retain the top wall and the bottom wall in parallel planar alignment to one another on opposite ends of the structural frame, the structural frame further configured to retain the back wall between the top wall and the bottom wall and in perpendicular alignment thereto.

6. The display case of claim 5, wherein the lighting system includes at least one lighting element attached to an inner side of the top wall.

7. The display case of claim 6, wherein the lighting element comprises a gimbaled light.

8. The display case of claim 5, further comprising a front wall, a first side wall, and a second side wall, wherein the structural frame is further configured to retain the front wall between the top wall and the bottom wall, opposite the back wall and in planar alignment to the back wall; and wherein the structural frame is further configured to retain the first side wall and the second side wall on opposite sides and between the top wall and the bottom wall, and in perpendicular alignment thereto.

9. The display case of claim 8, wherein at least one of the front wall, first side wall, and second side wall is magnetically attachable to the structural frame.

10. The display case of claim 5, further comprising a top stacking component on an outer side of the top wall, and a bottom stacking component on an outer side of the bottom wall, wherein the top stacking component comprises one of a stacking foot or a stacking cavity, wherein the bottom stacking component comprises the other one of said stacking foot or said stacking cavity, and wherein the stacking foot is configured to insert into the stacking cavity to stabilize multiple display cases which are stacked on top of one another.

* * * * *